United States Patent [19]

Khaidurov et al.

[11] 3,942,256

[45] Mar. 9, 1976

[54] AIMING DEVICE FOR MATCH WEAPONS

[76] Inventors: Efim Leontievich Khaidurov, ulitsa Glagoleva, 25, korpus 2, kv. 138, Moscow; Vladimir Alexandrovich Razorenov, ulitsa Ponomareva, 4-a, kv. 51, Minsk, both of U.S.S.R.

[22] Filed: Mar. 8, 1974

[21] Appl. No.: 449,250

[52] U.S. Cl. ..... 33/257; 33/260
[51] Int. Cl.[2] ..... F41G 1/18; F41G 1/10
[58] Field of Search ..... 33/256, 257, 258, 260

[56] References Cited

UNITED STATES PATENTS

| | | | |
|---|---|---|---|
| 3,748,744 | 7/1973 | McClenahan | 33/257 |

FOREIGN PATENTS OR APPLICATIONS

| | | | |
|---|---|---|---|
| 584,141 | 11/1924 | France | 33/256 |
| 1,117,003 | 11/1961 | Germany | 33/258 |

*Primary Examiner*—Richard E. Aegerter
*Assistant Examiner*—Richard R. Stearns
*Attorney, Agent, or Firm*—Lackenbach, Lilling & Siegel

[57] ABSTRACT

An aiming device for match weapons comprises a body with a backsight installed thereon, the body being fastened to an axle whose ends are installed in the openings of the base with a provision made for rotation and reciprocating movement by means of screws located in the body and used for vertical and horizontal corrections. Installed in the body is a mechanism for retaining the ends of the axle and the butts of the said screws in constant contact with the base.

This mechanism comprises a spring located in the sleeve of the body, and a slope formed on the bottom of the sleeve at the side of the external surface adjacent to an appropriate slope formed in the base.

The said mechanism provides for a constant elimination of all clearances in the movable joints of the aiming device in one direction, thereby providing, in turn, reliability and accuracy of operation of the device in the course of its entire service life.

11 Claims, 4 Drawing Figures

AIMING DEVICE FOR MATCH WEAPONS

The present invention relates to match weapons and, more particularly, to aiming devices for such weapons.

It is most expedient to use the aiming device embodied in the present invention for match pistols.

Known in the prior art are aiming devices for match pistols wherein the body (sight leaf) with the backsight mounted thereon is fastened on the axis. The ends of the axle are located in the openings formed in the base by means of which the aiming device is fastened to the frame of the weapon. The said axle installed in the openings of the base has provision for rotation and reciprocating movement by means of respective screws for vertical and horizontal corrections. The aiming device has a mechanism for retaining the ends of the axle installed in the openings of the base and the butts of the said screws in constant contact with the base. This mechanism represents two springs located in mutually perpendicular planes so that one end of each of them is pressed against the body, and the other end - against the base developing moments which hold in contact the said ends of the axles and the butts of the screws with the base. Dimensional restrictions are imposed on the match pistols which make it necessary to provide the aiming device compact and reliable in operation.

A disadvantage of the aiming device described above consists in that the mechanism which holds the ends of the axle and the butts of the screws of vertical and horizontal corrections in contact with the base comprises two springs located in mutually perpendicular planes. Each of these springs acts on one of the said screws. Such a design leads to an increase in the overall dimensions.

The object of the present invention is to provide such an aiming device wherein the mechanism for retaining the ends of the axle and the butts of the screws of vertical and horizontal corrections in contact with the base would have such a design that enables the overall dimensions of the aiming device to be decreased maintaining high reliability in the process of operation.

This object is accomplished in the aiming device for match weapons comprising a body with the backsight installed thereon so that it is fastened to the axle whose ends are located in the openings of the base with provision made for rotation and reciprocating movement by means of screws of vertical and horizontal corrections, and a mechanism for retaining the ends of the axle and the butts of the said screws in contact with the base wherein the said mechanism embodied in the invention represents a spring installed in the sleeve incorporated in the body, the sleeve being constructed with a slope on the external surface of the bottom adjacent to the slope formed in the base.

The aiming device for match weapons constructed according to the present invention has comparatively small overall dimensions and makes it possible to introduce accurate corrections in the position of the backsight, thereby providing accurate shooting at various aims.

A description of a specific embodiment of the present invention is given below with reference to the accompanying drawings, wherein.

Figure 1:
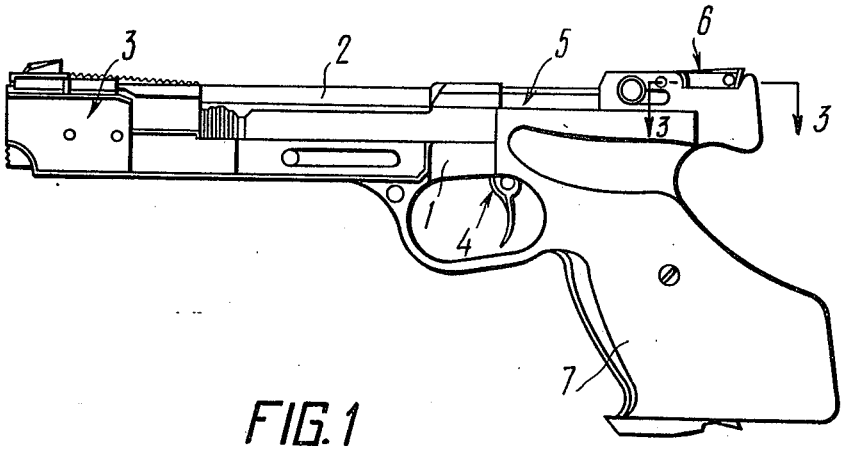
FIG. 1 is a side elevational view of a match pistol, according to the invention.

The match pistol comprises a frame 1 as shown in FIG. 1, and having mounted thereon is a barrel 2 with a compensator 3, a trigger mechanism 4, a bolt 5, an aiming device 6 and a handle 7.

Figure 2:
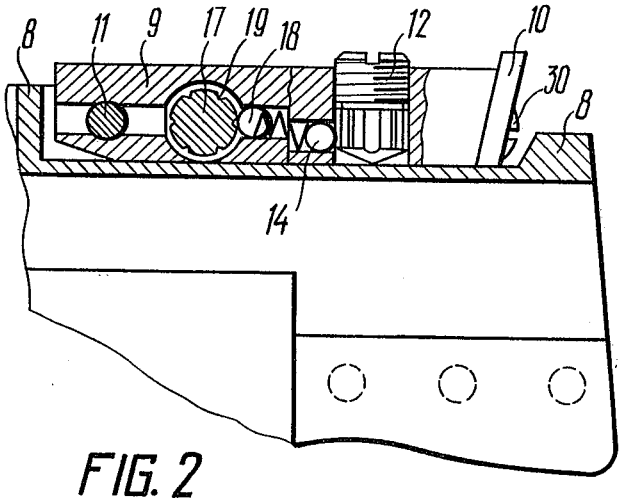
FIG. 2 is a fragmentary longitudinal sectional view taken on the plane passing through the pistol handle (section 2—2 of FIG. 3)
Figure 3:
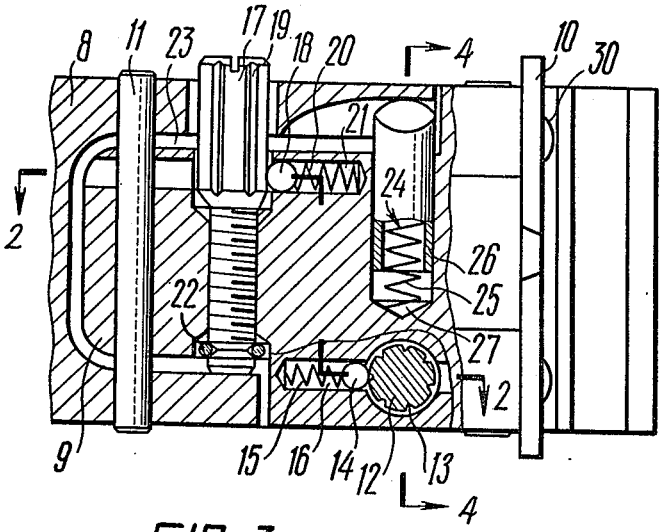
FIG. 3 is a sectional view on 3—3 of FIG. 1.
Figure 4:
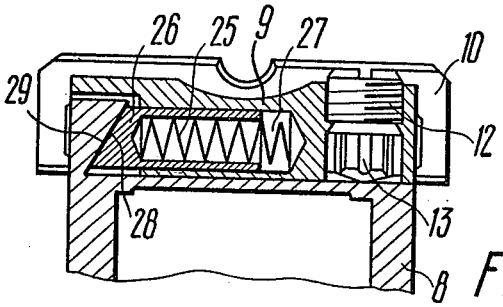
FIG. 4 is a sectional view taken along the line 4—4 of FIG. 3.

As best shown in FIGS. 2 and 3 the aiming device has a base 8 by means of which the device is fastened to the frame 1. The body 9 carrying the backsight 10 is mounted on the base 8.

The body 9 is rigidly fixed to the axle 11 whose ends are installed in the openings formed in the right-hand and left-hand walls of the base 8. (The right-hand and left-hand walls are considered in the direction of the aiming line). This axle is loosely installed in the openings of the base 8 with provision made for rotation therein and reciprocating movement about the base 8. The rotation of the axle 11 and, consequently, the body 9 about the base 8 is accomplished by the screw 12 of vertical corrections installed in the body 9, with the butt of the screw being adjacent to the base 8. Formed on the screw 12 are longitudinal grooves 13 bearing against one of which is a ball 14 loaded by means of a resilient element such as spring 15. To install the spring 15, a suitable opening is formed in the body 9. The ball 14 and the spring 15 fix the screw 12 in a pre-determined position. The reciprocating movement of the axle 11 and, consequently, the body 9 about the base 8 is accomplished by means of the screw 17 of horizontal corrections. This screw is installed in the body 9 parallel to the axle 11 spaced at a certain distance therefrom and its butt is adjacent to the body 9. The screw 17 is fixed in a pre-determined position by means of a ball 18 engageable in the form of a detent means with one of the longitudinal grooves 19 formed in the screw 17 and by the spring 20 (analogous to spring 15) located in the opening 21 formed in the body 9. The screws 12 and 17 are installed in the body 9 so that their heads are slightly extended over or beyond the body 9 and have screw driver splines. Such an installation of the screws 12 and 17 in the body 9 protects them against accidental movement inasmuch as the ball-detent means maintains them in their pre-determined positions. There is a clearance 23 between the body 9 and the base 8 which enables the body 9 to move about the base 8 in the process of horizontal corrections by means of the screw 17.

A biasing means or mechanism 24 is mounted in the body 9 for retaining the ends of the axle 11 and the butts of the screws 12 and 17 in constant contact with the base 8. This mechanism comprises a spring 25 and a sleeve-like plunger 26. To locate the spring 25 and the sleeve 26 in the body 9, an opening 27 is formed in the direction parallel to the opening for the screw 17. The spring 25 is so installed that one of its ends is pressed against the body 9 and the other end against the bottom of the sleeve 26. Formed on the external bottom of the sleeve 26 is the slope 28 which is adjacent to the slope 29 made in the right-hand wall of the base 8.

The backsight 10 is fastened to the body 9 by means of the screws 30 shown in FIGS. 2 and 3.

The aiming device for match weapons operates in the following manner.

For approximate adjustment fire of the pistol, it is necessary to install the body 9 in the middle position with respect to the base 8 by means of the screw 17 of horizontal corrections.

Then, by loosening the screws 30, the backsight 10 is transferred to the required position determined by the individual experience of the gunner. Thereafter, the screws 30 are tightened.

The accurate adjustment fire of the pistol is performed by the threaded means or screws 12 and 17 of the vertical and horizontal corrections, respectively.

When introducing horizontal corrections by rotating the screw 17, the body 9 is transferred to the right-hand or left-hand sides relative to the base 8 together with the axle 11 fastened thereon. In this case, the spring 25 constantly presses through the sleeve 26 the butt of the screw 17 to the left-hand wall of the base 8 developing a moment about the butt of the screw 17. This moment provides an elimination of the clearance of the axle 11 in the openings of the right-hand and left-hand walls of the base 8.

When introducing vertical corrections, the body is raised or lowered by rotating the screw 12. In this case, the slope 28 of the sleeve 26 slides upwards or downwards along the slope 29 formed in the base 8 on its right-hand wall. Since the slope 28 constantly tends to rotate the body 9 while interacting with the slope 29, the screw 12 is always pressed against the base 8.

Therefore, the effect of the spring 25 on the body 9 and on the base 8 through the sleeve with the slope 28 provides a constant elimination of all clearances in the movable joints of the aiming device arising in one direction due to the inaccuracy in fabricating the components of the device or to their wear because of durable operation.

A prototype of the aiming device constructed according to the present invention was installed on a match pistol and exhibited reliability in the process of operation and accuracy in introducing corrections.

What is claimed is:

1. An aiming device for match weapons comprising: a base and a body, having a backsight, said body being mounted on said base by means permitting rotatable movement about a pivot axis and translatable movement in a direction parallel to said axis; a pair of adjustable threaded means mounted on said body and adapted to bear against said base in mutually perpendicular planes for providing vertical and horizontal corrections to said backsight in said rotatable and translatable directions of movement; the translatable direction of movement of said body and the axis of rotation of said body being perpendicular to the axis of the weapon; and means for biasing the pair of threaded means into engagement with the base of said aiming device; said biasing means comprising a generally hollow element slidably mounted in said body, and said element having an open end and a closed sloped end; a resilient element in said hollow element bearing against said body and the bottom of said hollow element, whereby said closed sloped end of said hollow element is pressed against a mutually cooperatively shaped associated wall surface of said base by the action of said resilient element.

2. The aiming device according to claim 1, wherein said body is rigidly mounted about shaft means; and said shaft means being located in holding means provided in said base and being rotatable and reciprocable with respect thereto.

3. The aiming device according to claim 1, wherein said body is rigidly mounted about an axle-like shaft; the ends of said axle being located in apertures provided in said base and being rotatable and reciprocable with respect thereto.

4. The aiming device according to claim 3, wherein said base includes opposing walls having said apertures in said walls, and said apertures together defining an axis about which said body rotates and along which said body reciprocates.

5. The aiming device according to claim 1, wherein said threaded means comprise screws having splines.

6. The aiming device according to claim 5, including spring-loaded ball detent means bearing against said splines of said screws for fixing said screws in pre-determined positions.

7. The aiming device according to claim 1, wherein said backsight is removably secured to said body by fastener means.

8. The aiming device according to claim 3, wherein said resilient element in said hollow element comprises a compression spring; and said spring urges said closed sloped end of said hollow element against said sloped wall surface of said base.

9. The aiming device according to claim 3, wherein said shaft is secured to said body and the ends of said shaft are loosely fitted in said apertures.

10. An aiming device for a match weapon comprising: a base and a body, having a backsight, said body being mounted on said base by means permitting rotatable movement about a pivot axis and translatable movement in a direction parallel to said axis; a pair of adjustable threaded means mounted on said body and adapted to bear against said base in mutually perpendicular planes for providing vertical and horizontal corrections to said backsight in said rotatable and translatable directions of movement; the translatable direction of movement of said body and the axis of rotation of said body being perpendicular to the axis of the weapon; and means for biasing the pair of threaded means into engagement with the base of said aiming device; said biasing means comprising a spring loaded plunger mounted in said body, an end of which projects outwardly therefrom by the action of said spring; said end of said plunger having a generally flat surface forming an acute angle with the axis of said plunger, and bearing against a correspondingly angled wall surface of said base.

11. The aiming device according to claim 10, wherein said angled end portion of said plunger forms a dovetail type mating surface with the corresponding angled wall surface of said base, and said plunger exerting forces on said wall which urge said threaded means mounted on said body to continually bear against said base.

* * * * *